US011300337B2

(12) United States Patent
Jung et al.

(10) Patent No.: US 11,300,337 B2
(45) Date of Patent: Apr. 12, 2022

(54) OUTDOOR SYSTEM FOR AIR CONDITIONER

(71) Applicant: LG ELECTRONICS INC., Seoul (KR)

(72) Inventors: Jaehwa Jung, Seoul (KR); Daehyoung Kim, Seoul (KR); Junseong Park, Seoul (KR); Pilhyun Yoon, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 295 days.

(21) Appl. No.: 16/482,788

(22) PCT Filed: Feb. 1, 2018

(86) PCT No.: PCT/KR2018/001414

§ 371 (c)(1),
(2) Date: Aug. 1, 2019

(87) PCT Pub. No.: WO2018/143708

PCT Pub. Date: Aug. 9, 2018

(65) Prior Publication Data

US 2021/0278114 A1 Sep. 9, 2021

(30) Foreign Application Priority Data

Feb. 1, 2017 (KR) ..... 10-2017-0014470

(51) Int. Cl.
*F25B 41/40* (2021.01)
*F25B 41/31* (2021.01)
*F25B 41/24* (2021.01)

(52) U.S. Cl.
CPC ..... *F25B 41/40* (2021.01); *F25B 41/24* (2021.01); *F25B 41/31* (2021.01); *F25B 2400/075* (2013.01)

(58) Field of Classification Search
CPC ..... F25B 41/40; F25B 41/31; F25B 41/24; F25B 2400/075; F25B 2313/025;
(Continued)

(56) References Cited

U.S. PATENT DOCUMENTS 7,204,094 B2 * 4/2007 Cho ..... F25B 13/00 62/159
2005/0081540 A1 4/2005 Hwang et al.
(Continued)

FOREIGN PATENT DOCUMENTS

CN 1590872 3/2005
CN 1808020 7/2006
(Continued)

OTHER PUBLICATIONS

Chinese Office Action dated Aug. 17, 2020 issued in Application No. 201880009153.9.
(Continued)

*Primary Examiner* — Len Tran
*Assistant Examiner* — Jenna M Hopkins
(74) *Attorney, Agent, or Firm* — Ked & Associates LLP

(57) ABSTRACT

An outdoor system for an air conditioner may include at least one outdoor unit, the at least one outdoor unit including a compressor; an outdoor heat exchanger; a pair of two-stage compression lines that extends to outside of the outdoor system; a pair of connection lines that extends to the outside of the outdoor system and communicates with an indoor unit; and multiple valves that open/close the pair of two-stage compression lines and the pair of connection lines when the outdoor system is operated in a one-stage heating mode or a two-stage heating mode.

18 Claims, 5 Drawing Sheets

(58) Field of Classification Search
CPC ..... F25B 2313/021–0215; F25B 2313/0254; F25B 5/05; F25B 5/02; F25B 6/02; F25B 6/04; F24F 1/32; F24F 1/30; F24F 1/28; F24F 1/68
See application file for complete search history.

(56) References Cited

U.S. PATENT DOCUMENTS

| | | | | |
|---|---|---|---|---|
| 2009/0282849 | A1* | 11/2009 | Fujimoto | F25B 13/00 62/228.5 |
| 2010/0089085 | A1* | 4/2010 | Kawano | F25B 45/00 62/238.6 |
| 2013/0081417 | A1 | 4/2013 | Tamura et al. | |
| 2016/0201952 | A1 | 7/2016 | Jeong et al. | |

FOREIGN PATENT DOCUMENTS

| | | |
|---|---|---|
| CN | 201449081 | 5/2010 |
| CN | 101749880 | 6/2010 |
| CN | 101988717 | 3/2011 |
| CN | 103375935 | 10/2013 |
| CN | 103673438 | 3/2014 |
| CN | 104344594 | 2/2015 |
| CN | 104848599 | 8/2015 |
| CN | 105783145 | 7/2016 |
| DE | 2219208 | 12/1977 |
| EP | 2 988 074 | 2/2016 |
| JP | 2016-061489 | 4/2016 |
| KR | 10-2008-0080766 | 9/2008 |
| KR | 10-2010-0069188 | 6/2010 |
| KR | 10-1071409 | 10/2011 |
| KR | 10-1196505 | 11/2012 |
| KR | 10-2014-0094343 | 7/2014 |
| KR | 10-2016-0086652 | 7/2016 |
| WO | WO 2013/175725 | 11/2013 |

OTHER PUBLICATIONS

European Search Report dated Dec. 4, 2020 issued in EP Application No. 18747451.5.
Chinese Notice of Allowance dated Feb. 3, 2021.
International Search Report (with English Translation) and Written Opinion dated Jun. 4, 2018 issued in Application No. PCT/KR2018/001414.

* cited by examiner

OUTDOOR SYSTEM FOR AIR CONDITIONER

CROSS-REFERENCE TO RELATED PATENT APPLICATIONS

This application is a U.S. National Stage Application under 35 U.S.C. § 371 of PCT Application No. PCT/KR2018/001414, filed Feb. 1, 2018, which claims priority to Korean Patent Application No. 10-2017-0014470, filed Feb. 1, 2017, whose entire disclosures are hereby incorporated by reference.

TECHNICAL FIELD

The present invention relates to an outdoor system of an air conditioner.

BACKGROUND ART

An air conditioner is a home appliance for keeping indoor air in the most suitable condition according to usage and purpose thereof. For example, the air conditioner makes a room cool in the summer and makes the room warm in the winter. In addition, the air conditioner may control the humidity of the room and make indoor air clean.

Specifically, the air conditioner performs a refrigeration cycle for compressing, condensing, expanding and evaporating refrigerant to perform heating or cooling operation of an indoor space.

Such an air conditioner may be roughly classified into a separate air conditioner in which an indoor unit and an outdoor system are separately installed and an integrated air conditioner in which an indoor unit and an outdoor system are installed in one cabinet. An indoor heat exchanger for exchanging heat with indoor air is disposed in the indoor unit and an outdoor heat exchanger for exchanging heat with outdoor air is disposed in the outdoor system.

At this time, a plurality of outdoor systems may be provided. Each of the plurality of outdoor systems includes a compressor and an outdoor heat exchanger.

In general, the plurality of outdoor systems is connected in parallel such that refrigerant is circulated in each outdoor system. That is, refrigerant does not flow between different outdoor systems.

However, in an outdoor environment in which an outdoor temperature is very low, the plurality of outdoor systems may be connected in series to compress refrigerant in multiple stages. In this regard, the following prior art documents were disclosed.

(1) Prior Art 1: Korean Registered Patent No. 10-1071409 registered on Sep. 30, 2011 and entitled "System for generating hot water and cold water using a two-stage heat pump cycle"

(2) Prior Art 2: Korean Registered Patent No. 10-1196505 registered on Oct. 25, 2012 and entitled "Heat pump using two-stage compressor"

In Prior Arts 1 and 2, it is possible to achieve a required pressure ratio when an outdoor temperature is very low, by compressing refrigerant in two stages through a plurality of outdoor systems.

However, two-stage compression suffers from serious deterioration in the capacity and efficiency of the air conditioner except for a special case where the outdoor temperature is very low. Accordingly, inefficient operation may be performed in an area other than a special area.

DISCLOSURE

Technical Problem

An object of the present invention devised to solve the problem lies in an air conditioner capable of being switched between one-stage compression and two-stage compression.

Another object of the present invention devised to solve the problem lies in an air conditioner capable of achieving the above-described object by additionally installing a refrigerant pipe in an existing outdoor system without a separate device.

Technical Solution

An outdoor system of an air conditioner includes at least one outdoor unit, wherein the at least one outdoor unit includes a compressor, an outdoor heat exchanger, a pair of two-stage compression lines extending to the outside of the outdoor unit, a pair of connection lines extending to the outside of the outdoor unit to enable communication with an indoor unit, and a plurality of valves configured to open and close the pair of two-stage compression lines and the pair of connection lines when the outdoor unit is driven in any one of a one-stage heating mode and a two-stage heating mode.

The outdoor unit may include a first outdoor unit including a first compressor, a first outdoor heat exchanger and a pair of first connection lines, and a second outdoor unit including a second compressor, a second outdoor heat exchanger and a pair of second connection lines, and the first outdoor unit and the second outdoor unit may communicate with each other through the pair of two-stage compression lines.

The pair of two-stage compression lines may include a first two-stage compression line, through which refrigerant passing through the second outdoor heat exchanger flows into the first outdoor unit and a second two-stage compression line, through which refrigerant passing through the first compressor flows into the second outdoor unit.

The pair of first connection lines may include a first heat exchanger input/output line, through which gaseous refrigerant flows, and a first outdoor connection line, through which liquid refrigerant flows, and the pair of second connection lines may include a second heat exchanger input/output line, through which gaseous refrigerant flows, and a first outdoor system connection line, through which liquid refrigerant flows.

The plurality of valves may close the pair of two-stage compression lines when the first outdoor unit and the second outdoor unit are driven in the one-stage heating mode, and close the first outdoor system connection line when the first outdoor unit and the second outdoor unit are driven in the two-stage heating mode.

The plurality of valves may include a main four-way valve disposed at an inlet side of the compressor, and an auxiliary four-way valve disposed at an outlet side of the compressor, and, when the outdoor unit is switched from any one of the one-stage heating mode and the two-stage heating mode to the other thereof, any one of the main four-way valve and the auxiliary four-way valve may be switched.

The outdoor unit may include a first outdoor unit including a first compressor, a first outdoor heat exchanger, a first main four-way valve and a first auxiliary four-way valve and a second outdoor unit including a second compressor, a second outdoor heat exchanger, a second main four-way valve and a second auxiliary four-way valve, and, when the outdoor unit is switched from any one of the one-stage heating mode and the two-stage heating mode to the other thereof, any one of the first auxiliary four-way valve and the second main four-way valve may be switched.

The pair of connection lines may include a heat exchanger input/output line, through which the outdoor heat exchanger and the indoor unit communicate with each other, and the at least one outdoor unit may further include an injection line configured to connect the heat exchanger input/output line with the compressor.

The injection line may include an injection expansion valve and an injection heat exchanger configured to exchange heat between the injection line, through which refrigerant expanded by the injection expansion valve flows, and the heat exchanger input/output line.

The at least one outdoor unit may further include a two-stage compression injection line configured to connect at least one of the pair of two-stage compression lines with the compressor.

Advantageous Effects

The air conditioner according to the embodiment of the present invention may have the following effects.

It is possible to provide an air conditioner capable of operating in various operation modes such as a one-stage heating mode and a two-stage heating mode as necessary.

In particular, generally, the one-stage heating mode is performed as the heating mode. However, when an outdoor air is very low, the two-stage heating mode may be performed.

Since an inner pipe is installed in an outdoor system without requiring a separate device, it is possible to efficiently utilize a space.

In addition, it is possible to divide and use outdoor systems, through separation of refrigerant pipes.

MODE FOR INVENTION

Hereinafter, specific embodiments of the present invention will be described with reference to the drawings. It should be understood, however, that the spirit of the invention is not limited to the embodiments and that those skilled in the art, upon reading and understanding the spirit of the invention, may easily suggest other embodiments within the scope of the same concept.

Figure 1:
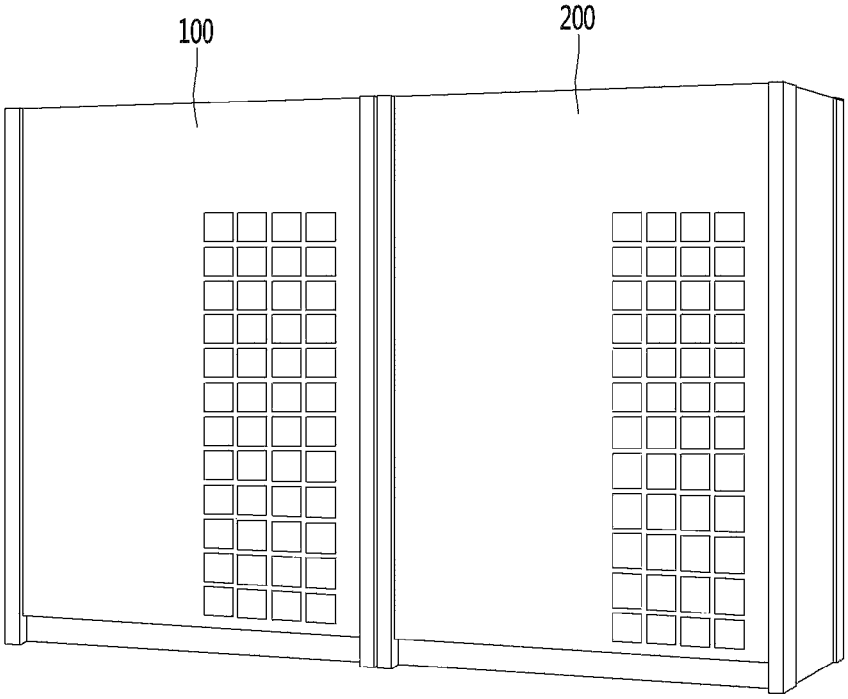
FIG. 1 is a diagram showing an outdoor system of an air conditioner according to an embodiment of the present invention.

FIG. 1 is a diagram showing an outdoor system of an air conditioner according to an embodiment of the present invention.

As shown in FIG. 1, the air conditioner includes at least one outdoor unit.

Hereinafter, one outdoor system shown in FIG. 1 is referred to as a first outdoor unit 100 and another outdoor system is referred to as a second outdoor unit 200. As shown in FIG. 1, the first outdoor unit 100 and the second outdoor unit 200 may have the same size and shape. However, this is merely illustrative and the first outdoor unit 100 and the second outdoor unit 200 may have various forms.

In addition, each of the first outdoor unit 100 and the second outdoor unit 200 may include at least one opening, for heat exchange with outdoor air.

The first outdoor unit 100 and the second outdoor unit 200 may be provided to be connected to an indoor unit. The first outdoor unit 100 and the second outdoor unit 200 are located outdoors and the indoor unit is located indoors. The first outdoor unit 100, the second outdoor unit 200 and the indoor unit are connected through refrigerant pipes to communicate with each other.

Figure 2:
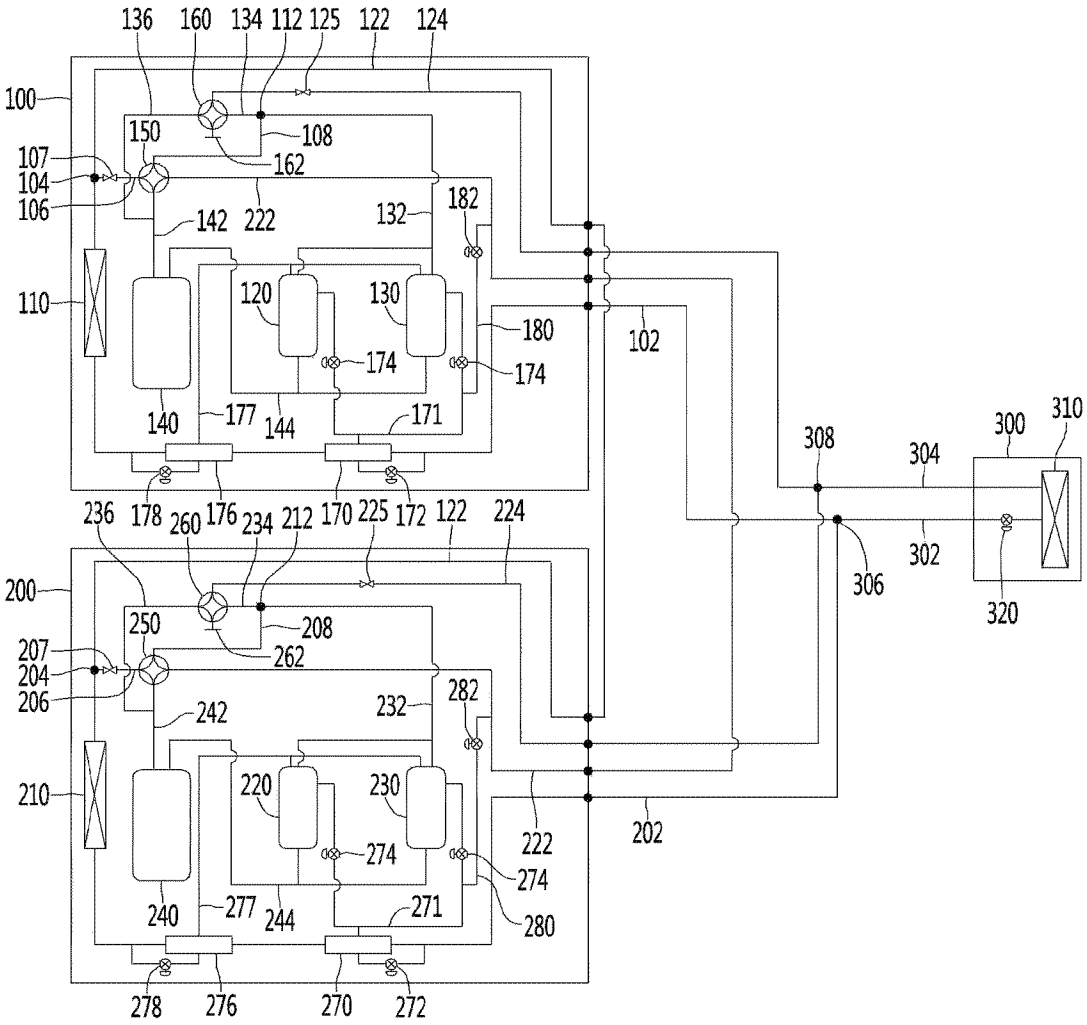
FIG. 2 is a diagram showing a refrigerant cycle of an air conditioner according to an embodiment of the present invention.

FIG. 2 is a diagram showing a refrigerant cycle of an air conditioner according to an embodiment of the present invention. The terms "main" and "auxiliary" used below are used to distinguish between components and are not intended to have different functions.

In addition, FIGS. 2 to 5 show a complete refrigerant cycle including the indoor unit 300 for the sake of understanding. The indoor unit 300 includes an indoor heat exchanger 310 and an indoor expansion valve 320.

As shown in FIG. 2, the first outdoor unit 100 and the second outdoor unit 200 have the same configuration. Hereinafter, the first outdoor unit 100 is referred to as an outdoor unit and the configuration thereof will be described.

The outdoor unit 10 includes an outdoor heat exchanger 110 and compressors 120 and 130.

The outdoor heat exchanger 110 is disposed in the outdoor unit 100 to exchange heat with outdoor air. In addition, the outdoor unit 100 includes a blower fan disposed adjacent to the outdoor heat exchanger 110 but is omitted for convenience of description.

The compressor includes a main compressor 120 and an auxiliary compressor 130 connected in parallel. The main compressor 120 and the auxiliary compressor 130 may have the same performance or may have different shapes and performances as necessary.

A gas-liquid separator 140 is disposed at an inlet side of the compressors 120 and 130. The gas-liquid separator 140 separates gaseous refrigerant before refrigerant flows into the compressors 120 and 130. Specifically, the gaseous refrigerant separated by the gas-liquid separator 140 divisionally flows into the main compressor 120 and the auxiliary compressor 130.

In addition, the outdoor unit 100 includes a pair of two-stage compression lines 122 and 222 and a pair of connection lines 102 and 124 extending to the outside of the outdoor unit 100. That is, four refrigerant pipes extend to the outside of the outdoor unit 100, such that refrigerant is introduced into or discharged from the outdoor unit 100.

The pair of connection lines 102 and 124 extends to communicate with the indoor unit 300. In addition, the pair of connection lines includes a heat exchanger input/output line 102, through which gaseous refrigerant flows, and an outdoor system connection line 124, through which liquid refrigerant flows.

The pair of two-stage compression lines 122 and 222 extends to communicate with another outdoor unit. At this time, the pair of two-stage compression lines 122 and 222 may be used only when connection with another outdoor unit is required. That is, if a single outdoor unit is used, the pair of two-stage compression lines 122 and 222 may be closed without being connected to another outdoor unit.

In addition, the outdoor unit 100 includes a plurality of valves for opening and closing the pair of two-stage compression lines 122 and 222 and the pair of connection lines 102 and 124. The plurality of valves includes a main four-way valve 150 disposed at an inlet side of the compressors 120 and 130 and an auxiliary four-way valve 160 disposed at an outlet side of the compressors 120 and 130.

In addition, the plurality of valves includes a main valve 107 and an auxiliary valve 125 for opening and closing flow of refrigerant.

Hereinafter, the refrigerant line of the outdoor unit 100 will be described in detail based on the above-described configuration. The refrigerant line may be understood as a refrigerant pipe, through which the refrigerant flows, and includes the pair of two-stage compression lines 122 and 222 and the pair of connection lines 102 and 124. The term "branch portion" used below means a portion in which three or more refrigerant pipes are coupled.

The heat exchanger input/output line 102 is one of the pair of connection lines to connect the indoor unit 300 with the outdoor unit 100. Specifically, one end of the heat exchanger input/output line 102 is connected to a first indoor unit connection line 302 extending from the indoor heat exchanger 320.

The first indoor unit connection line 302 may be understood as a portion of the heat exchanger input/output line 102 such that the heat exchanger input/output line 102 enables communication between the indoor unit 300 and the outdoor unit 100. At this time, a connection point between the heat exchanger input/output line 102 and the first indoor unit connection line 302 is referred to as a first branch portion 306.

In addition, the indoor expansion valve 320 is installed in the first indoor unit connection line 302. In particular, the indoor expansion valve 320 may be installed in the first indoor unit connection line 302 located inside the indoor unit 300.

The other end of the heat exchanger input/output line 102 extends to penetrate through the outdoor heat exchanger 110. In addition, a portion of the heat exchanger input/output line 102 may be understood as the outdoor heat exchanger 110 for exchanging heat with outdoor air.

The heat exchanger input/output line 102 penetrating through the outdoor heat exchanger 110 is coupled to a second branch portion 104. That is, the heat exchanger input/output line 102 extends from the first branch portion 306 to the second branch portion 104.

The second branch portion 104 having one side connected to the heat exchanger input/output line 102 is connected to a first two-stage compression line 122 and a main connection line 106.

The first two-stage compression line 122 is one of the pair of two-stage compression lines. As described above, the first two-stage compression line 122 may extend to the outside of the outdoor unit 100 to be used upon connection with another outdoor unit.

In addition, the main connection line 106 connects the second branch portion 104 with the main four-way valve 150. The main valve 107 is installed in the main connection line 106. The main valve 107 may block flow of refrigerant in the main connection line 106.

The main four-way valve 150 is connected with the main connection line 106, a gas-liquid separator introduction line 142, an auxiliary connection line 108, and a second two-stage compression line 222. At this time, the first main four-way valve 150 may operate such that the main connection line 106 and the gas-liquid separator introduction line 142 respectively communicate with the auxiliary connection line 108 and the second two-stage compression line 222. In addition, the main four-way valve 150 may operate such that the main connection line 106 and the auxiliary connection line 108 respectively communicate with the gas-liquid separator introduction line 142 and the second two-stage compression line 222.

At this time, the second two-stage compression line 222 configures the pair of two-stage compression lines along with the first two-stage compression line 122. As described above, the second two-stage compression line 122 extends to the outside of the outdoor unit 100 to be used upon connection with another outdoor unit.

In addition, the gas-liquid separator introduction line 142 extends to the gas-liquid separator 140. In addition, the auxiliary connection line 108 extends to a third branch portion 112.

The third branch portion 112 having one side connected to the first auxiliary connection line 108 is connected to an auxiliary line 134 and a compressor discharge line 132.

The compressor discharge line 132 is connected with the main compressor 120 and the auxiliary compressor 130. In addition, the main compressor 120 and the auxiliary compressor 130 are connected to the gas-liquid separator 140 through the compressor introduction line 144. The compressor introduction line 144 may be understood as a gas-liquid separator discharge line.

At this time, in flow of the refrigerant passing through the gas-liquid separator 140, the main compressor 120 and the auxiliary compressor 130, the refrigerant flowing into the gas-liquid separator 140 through the gas-liquid separator introduction line 142 is separated into gas and liquid refrigerants to flow to the main compressor 120 and the auxiliary compressor 130 along the compressor introduction line 144 (gas-liquid separator discharge line). The refrigerants compressed by the main compressor 120 and the auxiliary compressor 130 flow to the third branch portion 112 along the compressor discharge line 132.

The auxiliary line 134 extends to the auxiliary four-way valve 160.

The auxiliary four-way valve 160 is connected with the auxiliary line 134, a cooling line 136, the outdoor system connection line 124 and a cutting portion 162. At this time, the auxiliary four-way valve 160 may operate such that the auxiliary line 134 and the outdoor system connection line 124 may operate such that the auxiliary line 134 and the outdoor system connection line 124 respectively communicate with the cooling line 136 and the cutting portion 162. In addition, the auxiliary four-way valve 160 may operate such that the auxiliary line 134 and the cutting portion 162 respectively communicate with the cooling line 136 and the outdoor system connection line 124.

At this time, the cutting portion 162 means a place where a pipe is closed to prevent refrigerant from flowing.

In addition, the cooling line 136 extends to the gas-liquid separator introduction line 142. That is, one end of the cooling line 136 is coupled to the auxiliary four-way valve 160 and the other end thereof is coupled to one side of the gas-liquid separator introduction line 142. Accordingly, the cooling line 136 communicates with the gas-liquid separator introduction line 142.

In addition, as described above, the outdoor system connection line 124 is one of the pair of connection lines to connect the indoor unit 300 with the outdoor unit 100.

Specifically, one end of the outdoor system connection line 124 is connected to a second indoor unit connection line 304 extending from the indoor heat exchanger 320.

The second indoor unit connection line 304 is understood as a portion of the outdoor system connection line 124 and the outdoor system connection line 124 may enable communication between the indoor unit 300 and the outdoor unit 100. At this time, a connection point between the outdoor system connection line 124 and the second indoor unit connection line 304 is referred to as a fourth branch portion 308.

The outdoor unit 100 may form one refrigerant cycle with the indoor unit 300. That is, the outdoor unit 100 may be used alone.

In addition, the outdoor unit 100 includes an injection heat exchanger and an injection valve, to which a vapor injection technology is applied. A plurality of injection heat exchangers and injection valves may be installed and the installation positions thereof may be various.

As shown in FIG. 2, the outdoor unit 100 includes injection lines 171 and 177 for connecting the heat exchanger input/output line 102 with the compressors 120 and 130. Injection expansion valves 172 and 178 and injection heat exchangers 170 and 176 may be installed in the injection lines 171 and 177.

Specifically, a main injection heat exchanger 170 and an auxiliary injection heat exchanger 176 are installed in the heat exchanger input/output line 102. For convenience of description, the main injection heat exchanger 170 is disposed adjacent to the first branch portion 306 and the auxiliary injection heat exchanger 176 is disposed adjacent to the outdoor system heat exchanger 110.

In addition, a refrigerant line in which the main injection heat exchanger 170 is referred to as a main injection line 171 and a refrigerant line in which the auxiliary injection heat exchanger 176 is installed is referred to as an auxiliary injection line 177.

A main injection expansion valve 172 and an auxiliary injection expansion valve 178 are installed in the main injection line 171 and the auxiliary injection line 177. In addition, at least one injection valve 174 may be installed in the main injection line 171 and the auxiliary injection line 177. At this time, the injection valve 174 may be understood as a valve for opening or closing flow of the refrigerant.

The main injection line 171 and the auxiliary injection line 177 extend to the main compressor 120 and the auxiliary compressor 130. That is, the main injection line 171 and the auxiliary injection line 177 connect the heat exchanger input/output line 102 with the main compressor 120 and the auxiliary compressor 130.

In addition, the outdoor unit 100 may include a two-stage compression injection line 180 for connecting at least one of the pair of two-stage compression lines 122 and 222 with the compressors 120 and 130.

Specifically, the two-stage compression injection line 180 connects the second two-stage compression line 222 with the main compressor 120 and the auxiliary compressor 130. A two-stage compression injection expansion valve 182 is installed in the two-stage compression injection line 180.

As described above, the air conditioner according to the embodiment of the present invention may include a plurality of outdoor units having the same configuration. That is, the first outdoor unit 100 and the second outdoor unit 200 may be provided.

The first outdoor unit 100 and the second outdoor unit 200 have the same configuration and refrigerant line. The configuration and refrigerant line installed in the first outdoor unit 100 are represented as "first" and the configuration and refrigerant line installed in the second outdoor unit 200 are represented as "second".

Accordingly, the first outdoor unit 100 includes a first compressor including a first main compressor 120 and a first auxiliary compressor 130, a first outdoor system heat exchanger 110, a first gas-liquid separator 140, a first main four-way valve 150, a first auxiliary four-way valve 160, a first main valve 107 and a first auxiliary valve 125.

In addition, a pair of first connection line including a first heat exchanger input/output line 102 and a first outdoor system connection line 124, a first main connection line 106, a first gas-liquid separator introduction line 142, a first compressor introduction line 144 (a first gas-liquid separator discharge line), a first compressor discharge line 132, a first auxiliary line 134, a first cutting portion 162, a first auxiliary connection line 108 and a first cooling line 136 are included.

In addition, a first main injection heat exchanger 170, a first auxiliary injection heat exchanger 176, a first main injection line 171, a first auxiliary injection line 177, a first main injection expansion valve 172, a first auxiliary injection expansion valve 178, a first two-stage compression injection line 180, a first two-stage compression injection expansion valve 182 and a first injection valve 174 are included.

The second outdoor unit 200 includes a second compressor including a second main compressor 220 and a second auxiliary compressor 230, a second outdoor heat exchanger 210, a second gas-liquid separator 240, a second main four-way valve 250, a second auxiliary four-way valve 260, a second main valve 207 and a second auxiliary valve 225.

In addition, a pair of second connection lines including a second heat exchanger input/output line 202 and a second outdoor system connection line 224, a second main connection line 206, a second gas-liquid separator introduction line 242, a second compressor introduction line 244 (a second gas-liquid separator discharge line), a second compressor discharge line 232, a second auxiliary line 234, a second cutting portion 262, a second auxiliary connection line 208 and a second cooling line 236 are included.

In addition, a second main injection heat exchanger 270, a second auxiliary injection heat exchanger 276, a second main injection line 271, a second auxiliary injection line 277, a second main injection expansion valve 272, a second auxiliary injection expansion valve 278, a second two-stage compression injection line 280, a second two-stage compression injection expansion valve 282 and a second injection valve 274 are included.

In addition, the first outdoor unit 100 includes the second branch portion 104 and the third branch portion 112, and the second outdoor unit 200 includes a fifth portion 204 and a sixth branch portion 212.

At this time, the first branch portion 306 connects a first indoor unit connection line 302 connected to the indoor heat exchanger 310, the first heat exchanger input/output line 102 connected to the first outdoor system heat exchanger 110 and the second heat exchanger input/output line 202 connected to the second outdoor heat exchanger 210.

In addition, the fourth branch portion 308 connects the second indoor unit connection line 304 connected to the indoor heat exchanger 310, the first outdoor system connection line 124 and the second outdoor system connection line 224.

That is, the first outdoor unit 100 and the second outdoor unit 200 are connected to the indoor unit 300 in parallel. Accordingly, the first outdoor unit 100 and the second outdoor unit 200 may independently operate.

In addition, the first outdoor unit 100 and the second outdoor unit 200 may communicate with each other through the pair of two-stage compression lines 122 and 222. As described above, the pair of two-stage compression lines 122 and 222 may connect a plurality of outdoor units as necessary.

That is, the first outdoor unit 100 and the second outdoor unit 200 may be connected to the indoor unit 300 in series. Accordingly, the first outdoor unit 100 and the second outdoor unit 200 may operate as one unit.

The first outdoor unit 100 and the second outdoor unit 200 may operate independently or as one unit. Therefore, the outdoor system of the air conditioner may operate in various operation modes.

Hereinafter, each mode of the air conditioner operating in various operation modes through the refrigerant cycle will be described. The flow of the refrigerant is indicated by a thick line, and the flow of refrigerant is blocked or refrigerant rarely flows in the remaining portion.

Figure 3:
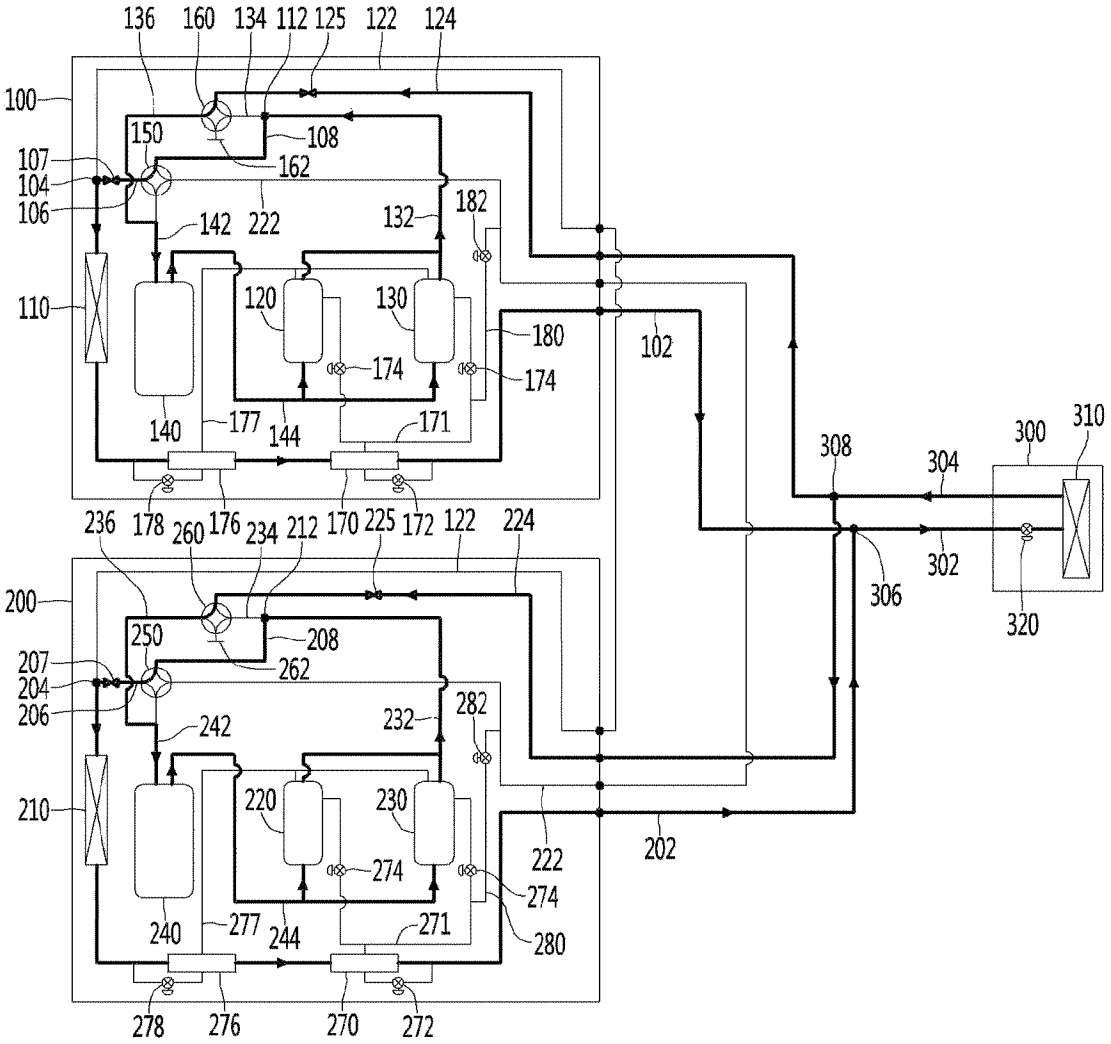
FIG. 3 is a diagram showing a cooling mode of an air conditioner according to an embodiment of the present invention.

FIG. 3 is a diagram showing a cooling mode of an air conditioner according to an embodiment of the present invention.

In a cooling mode, the indoor heat exchanger 310 functions as an evaporator and the outdoor heat exchangers 110 and 210 function as condensers. Accordingly, refrigerant is sequentially circulated in order of the compressor, the outdoor heat exchanger, the expansion valve and the indoor heat exchanger.

Hereinafter, the refrigerant circulation process starting in the indoor heat exchanger 310 will be described.

The refrigerant discharged from the indoor heat exchanger 310 flows from the indoor unit 300 to the fourth branch portion 308 along the second indoor unit connection line 304. In the fourth branch portion 308, the refrigerant flows to the first outdoor unit 100 and the second outdoor unit 200 along the first outdoor system connection line 124 and the second outdoor system connection line 224.

The refrigerant flowing to the first outdoor unit 100 along the first outdoor system connection line 124 flows to the first cooling line 136 in the first auxiliary four-way valve 160. In addition, the refrigerant flows into the first gas-liquid separator 140 through the first gas-liquid separator introduction line 142 communicating with the first cooling line 136.

Then, the refrigerant is discharged from the first gas-liquid separator 140 to flow along the first compressor introduction line 144, is compressed in the first main compressor 120 and the first auxiliary compressor 130, and is discharged to the first compressor discharge line 132.

The discharged refrigerant flows along the first auxiliary connection line 108 at the third branch portion 112 and flows to the first main connection line 106 at the first main four-way valve 150. In addition, the refrigerant flows to the second branch portion 104 along the first main connection line 106 and passes through the first outdoor heat exchanger 110 along the first heat exchanger input/output line 102.

Finally, the refrigerant flows from the first outdoor unit 100 to the first branch portion 306 along the first heat exchanger input/output line 102. The refrigerant flows to the indoor unit 300 at the first branch portion 306 along the first indoor unit connection line 302. In addition, the refrigerant expands in the indoor expansion valve 320 and flows to the indoor heat exchanger 310 again, thereby being circulated.

The refrigerant flowing to the second outdoor unit 200 along the second outdoor system connection line 224 passes through the second cooling line 236, the second gas-liquid separator introduction line 242, the second compressor introduction line 244, the second compressor discharge line 232, the second auxiliary connection line 208 and the second main connection line 206 and flows along the second heat exchange input/output line 202.

The refrigerant flowing along the second heat exchanger input/output line 202 is combined with the refrigerant passing through the first outdoor unit 100 at the first branch portion 306, flowing into the indoor unit 300.

The first outdoor unit 100 and the second outdoor unit 200 form independent refrigerant cycles, respectively. Accordingly, even when only at least one of the first outdoor unit 100 and the second outdoor unit 200 is driven, the air conditioner may operate in the cooling mode.

Figure 4:
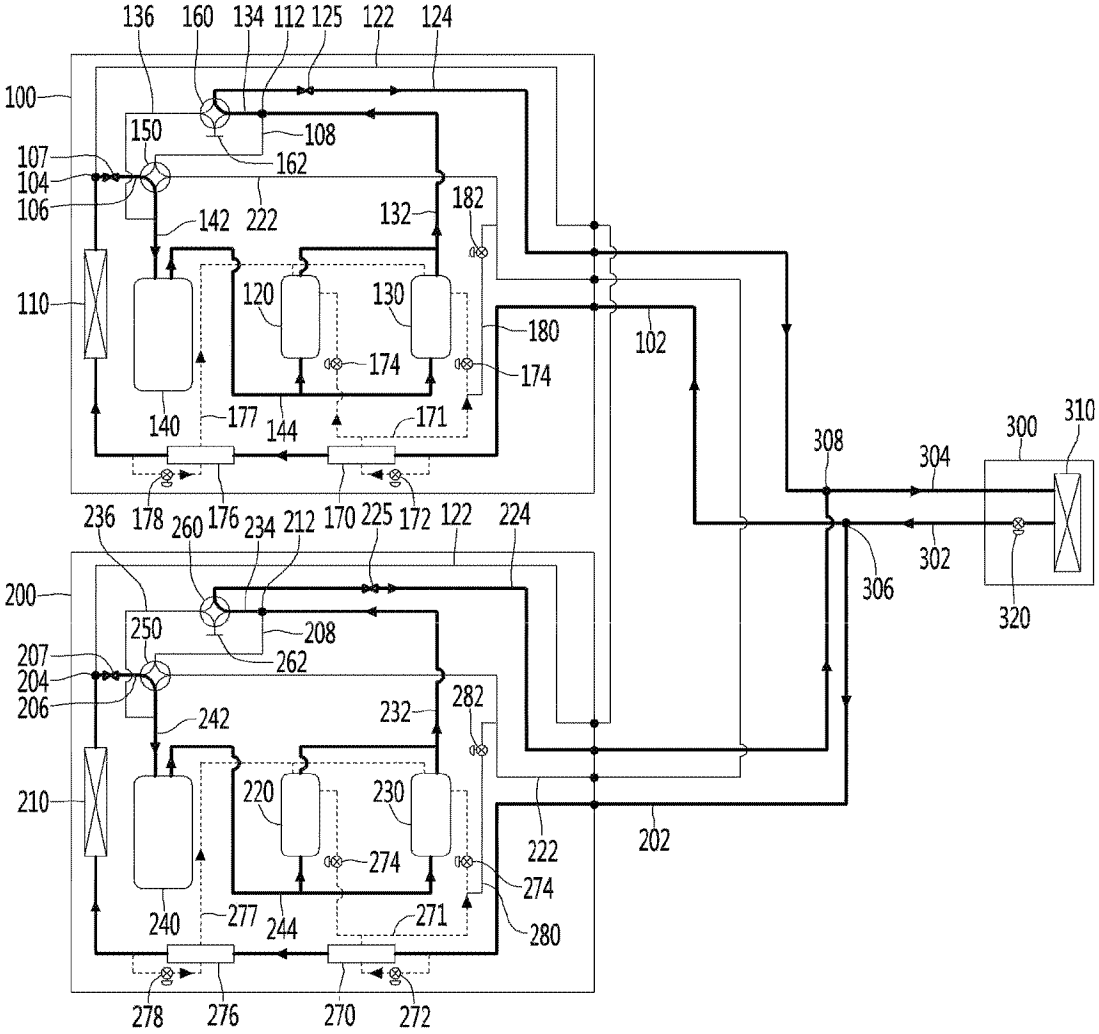
FIG. 4 is a diagram showing a one-stage heating mode of an air conditioner according to an embodiment of the present invention.

FIG. 4 is a diagram showing a one-stage heating mode of an air conditioner according to an embodiment of the present invention. An one-stage heating mode generally operates when heating is required.

In the one-stage heating mode, the indoor heat exchanger 310 functions as a condenser and the outdoor heat exchangers 110 and 210 function as evaporators. Accordingly, the refrigerant is sequentially circulated in order of the compressor, the indoor heat exchanger, the expansion valve and the outdoor heat exchanger.

Hereinafter, the refrigerant circulation process starting in the indoor heat exchanger 310 will be described in detail.

The refrigerant discharged from the indoor heat exchanger 310 flows from the indoor unit 300 along the first indoor unit connection line 302. At this time, the refrigerant expands while passing through the indoor expansion valve 320.

The refrigerant flowing to the first branch portion 306 flows to the first outdoor unit 100 and the second outdoor unit 200 along the first heat exchanger input/output line 102 and the second heat exchanger input line 202.

The refrigerant flowing to the first outdoor unit 100 along the first heat exchanger input/output line 102 flows to the second branch portion 104 through the first outdoor heat exchanger 110. In addition, the refrigerant flows to the first main connection line 106 at the second branch portion 104 and flows to the first gas-liquid separator introduction line 142 at the first main four-way valve 150.

The refrigerant flowing into the first gas-liquid separator 140 through the first gas-liquid separator introduction line 142 is discharged from the first gas-liquid separator 140 to flow along the first compressor introduction line 144, is compressed in the first main compressor 120 and the first auxiliary compressor 130, and is discharged to the first compressor discharge line 132.

The discharged refrigerant flows along the first auxiliary line 134 at the third branch portion 112 and flows to the first outdoor system connection line 124 at the first auxiliary four-way valve 160.

Finally, the refrigerant flows along the first outdoor system connection line 124 and flows to the indoor unit 300 at the fourth branch portion 308 along the second indoor unit connection line 304. Therefore, the refrigerant flows to the indoor heat exchanger 310 again, thereby being circulated.

The refrigerant flowing to the second outdoor unit 200 along the second heat exchanger input/output line 202 passes through the second main connection line 206, the second gas-liquid separator introduction line 242, the second compressor introduction line 244, the second compressor discharge line 232 and the second auxiliary line 234 and flows along the second outdoor system connection line 224.

The refrigerant is combined with the refrigerant passing through the first outdoor unit 100 at the fourth branch portion 308, flowing to the indoor unit 300.

The first outdoor unit 100 and the second outdoor unit 200 form independent refrigerant cycles, respectively. Accordingly, even when only at least one of the first outdoor unit 100 and the second outdoor unit 200 is driven, the air conditioner may operate in the cooling mode.

In addition, in a one-stage heating mode, refrigerant may flow to the injection heat exchanger and the injection expansion valve as necessary. The flow of the refrigerant is shown by a dotted line in FIG. 4.

Some of the refrigerant flowing along the first heat exchanger input/output line 102 flows along the first main injection line 171. The refrigerant flowing along the first main injection line 171 is expanded in the first main injection expansion valve 172.

The first main injection heat exchanger 170 performs heat exchange between the refrigerant flowing along the first heat exchanger input/output line 102 and the refrigerant flowing along the first main injection line 171. Specifically, the refrigerant, the pressure and temperature of which decreases while passing through the first main injection expansion valve 172, exchanges heat with the refrigerant flowing in the first heat exchanger input/output line 102.

Therefore, the refrigerant passing through the first main injection line 171 receives heat to evaporate and the refrigerant passing through the first heat exchanger input/output line 102 loses heat.

The refrigerant evaporated in the first main injection heat exchanger 170 is supplied to the first main compressor 120 and the first auxiliary compressor 130.

In addition, the refrigerant passing through the first main injection heat exchanger 170 and flowing along the first heat exchanger input/output line 102 may further lose heat while passing through the first auxiliary injection heat exchanger 176.

In addition, the second main injection heat exchanger 270 and the second auxiliary injection heat exchanger 276 installed in the second outdoor unit 200 may also operate.

A user may control and selectively use the first main injection expansion valve 172, the first auxiliary injection expansion valve 178, the first injection valve 174, the second main injection expansion valve 272, the second auxiliary injection expansion valve 278 and the second injection valve 274 as necessary.

Figure 5:
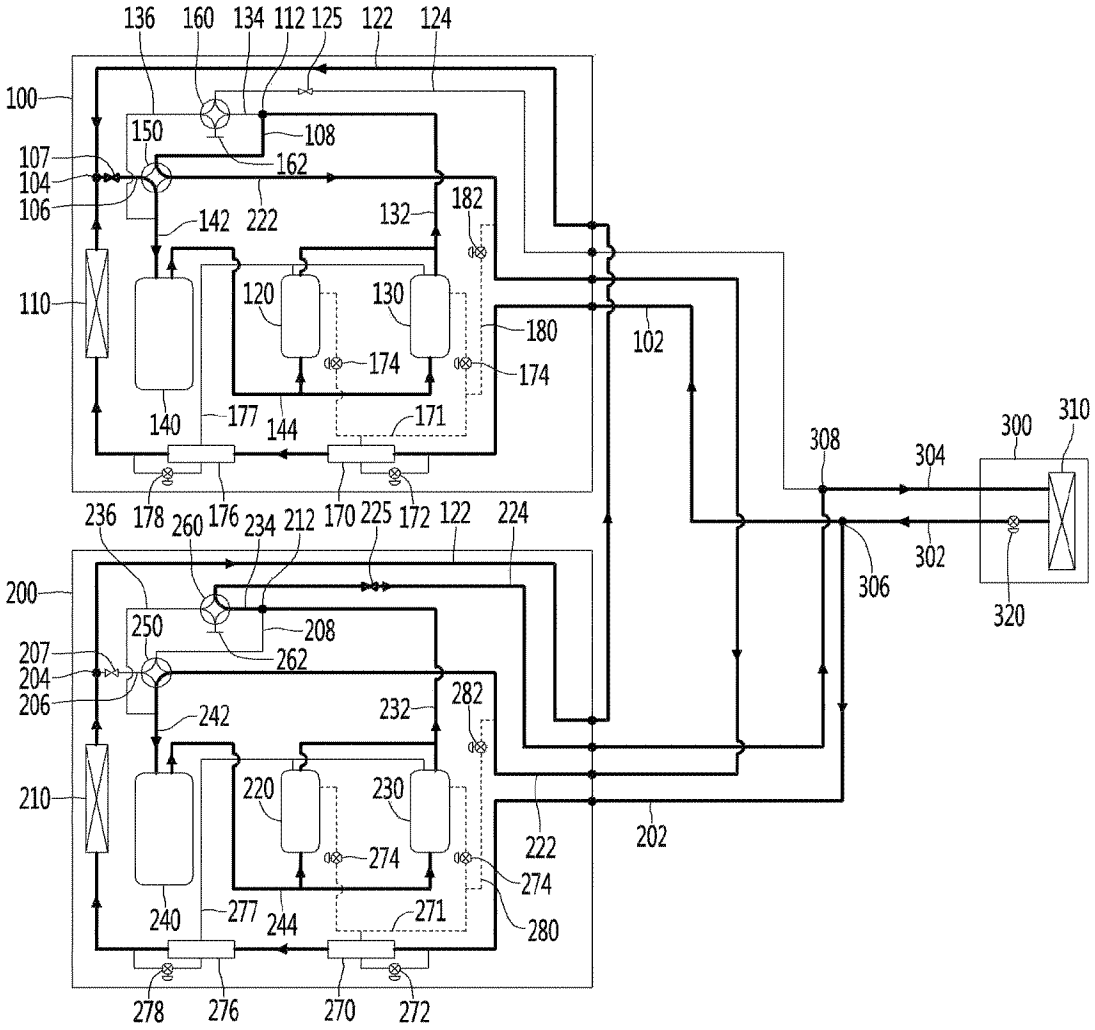
FIG. 5 is a diagram showing a two-stage heating mode of an air conditioner according to an embodiment of the present invention.

FIG. 5 is a diagram showing a two-stage heating mode of an air conditioner according to an embodiment of the present invention. The two-stage heating mode operates in a special case where the outdoor temperature is very low. For example, the two-stage heating mode may operate when the outdoor temperature is equal to or less than −20 degrees.

In the two-stage heating mode, the indoor heat exchanger 310 functions as a condenser and the outdoor heat exchangers 110 and 210 function as evaporators like the normal heating mode. Accordingly, the refrigerant is sequentially circulated in order of the compressor, the indoor heat exchanger, the expansion valve and the outdoor heat exchanger.

Hereinafter, the refrigerant circulation process starting in the indoor heat exchanger 310 will be described in detail.

The refrigerant discharged from the indoor heat exchanger 310 flows from the indoor unit 300 along the first indoor unit connection line 302. At this time, the refrigerant is expanded while passing through the indoor expansion valve 320.

The refrigerant flowing to the first branch portion 306 is branched, flowing to the first outdoor unit 100 and the second outdoor unit 200 along the first heat exchanger input/output line 102 and the second heat exchanger input/output line 202.

The refrigerant flowing to the first outdoor unit 100 along the first heat exchanger input/output line 102 flows to the second branch portion 104 through the first outdoor heat exchanger 110.

In addition, the refrigerant flowing to the second outdoor unit 200 along the second heat exchanger input/output line 202 flows to the fifth branch portion 204 through the second outdoor heat exchanger 210.

The refrigerant flows to the first two-stage compression line 122 at the fifth branch portion 204. At this time, the second main valve 207 installed in the second main connection line 206 blocks the flow of the refrigerant. Accordingly, the refrigerant flows from the second outdoor unit 200 to the first outdoor unit 100 along the first two-stage compression line 122.

The refrigerant flowing to the first outdoor unit 100 is combined with the refrigerant passing through the first outdoor heat exchanger 110 at the second branch portion 104, flowing to the first main connection line 106. That is, the refrigerant passing through the first outdoor heat exchanger 110 and the refrigerant passing through the second outdoor heat exchanger 210 are mixed to flow.

The refrigerant flowing to the first main connection line 106 at the second branch portion 104 flows to the first gas-liquid separator introduction line 142 at the first main four-way valve 150.

The refrigerant flowing into the first gas-liquid separator 140 through the first gas-liquid separator introduction line 142 is discharged from the first gas-liquid separator 140 to flow along the first compressor introduction line 144, is compressed in the first main compressor 120 and the first auxiliary compressor 130, and is discharged to the first compressor discharge line 132.

The discharged refrigerant flows along the first auxiliary connection line 108 at the third branch portion 112 and flows to the second two-stage compression line 222 at the first main four-way valve 150.

Accordingly, the refrigerant flows from the first outdoor unit 100 to the second outdoor unit 200 along the second two-stage compression line 222. The refrigerant flowing to the second outdoor unit 200 flows to the second gas-liquid separator introduction line 242 at the second main four-way valve 250.

The refrigerant flowing into the second gas-liquid separator 240 through the second gas-liquid separator introduction line 242 is discharged from the second gas-liquid separator 240 to flow along the second compressor introduction line 244, is compressed in the second main compressor 220 and the second auxiliary compressor 230, and is discharged to the second compressor discharge line 232.

The discharged refrigerant flows along the second auxiliary line 234 at the sixth branch portion 212 and flows to the second outdoor system connection line 224 at the second auxiliary four-way valve 260.

Finally, the refrigerant flows from the second outdoor unit 200 to the fourth branch portion 308 along the second outdoor system connection line 224 and flows along the second indoor unit connection line 304.

In the two-stage heating mode, the first outdoor unit 100 and the second outdoor unit 200 operate as one unit, unlike the cooling mode and the one-stage heating mode in which the first outdoor unit 100 and the second outdoor unit 200 independently operate.

In summary, the refrigerant introduced from the indoor heat exchanger 310 is branched and supplied to the first outdoor heat exchanger 110 and the second outdoor heat exchanger 210. The refrigerants evaporated in the first outdoor heat exchanger 110 and the second outdoor heat exchanger 210 are combined again and compressed by the first main compressor 120 and the first auxiliary compressor 130 (one-stage compression).

In addition, the one-stage compressed refrigerant is compressed again by the second main compressor 220 and the second auxiliary compressor 230 (two-stage compression). The two-stage compressed refrigerant is supplied to the indoor heat exchanger 310 again.

That is, in the one-stage heating mode, the refrigerants flowing to the first heat exchanger input/output line 102 and the second heat exchanger input/output line 202 are compressed by the first compressors 120 and 130 and the second compressors 220 and 230, flowing to the indoor unit 300 along the first outdoor system connection line 124 and the second outdoor system connection line 224.

In addition, in the two-stage heating mode, the refrigerants flowing to the first heat exchanger input/output line 102 and the second heat exchanger input/output line 202 are sequentially compressed in the first compressors 120 and 130 and the second compressors 220 and 230, thereby flowing to the indoor unit 300 along the second outdoor system connection line 224.

In comparison between the one-stage heating mode and the two-stage heating mode, it is possible to obtain maximum efficiency in the one-stage heating mode and to obtain a maximum pressure ratio in the two-stage heating mode. Accordingly, it is possible to achieve appropriate heating, by switching the one-stage heating mode and the two-stage heating mode according to external conditions.

In addition, in the two-stage heating mode, the refrigerant may flow to the injection heat exchanger and the injection expansion valve as necessary. The flow of the refrigerant is shown by a dotted line in FIG. 5. In addition, the injection line described in the one-stage heating mode may be used even in the two-stage heating mode. For the injection line, refer to the description of the one-stage heating mode.

As described above, the first outdoor unit 100 and the second outdoor unit 200 include the two-stage compression injection lines 180 and 280 and the two-stage compression injection expansion valves 182 and 282, respectively.

Some of the refrigerant flowing along the second two-stage compression line 222 flows along the first two-stage compression injection line 180. The refrigerant flowing along the first two-stage compression injection line 180 is expanded in the first two-stage compression injection expansion valve 182.

The refrigerant expanded in the first two-stage compression injection expansion valve 182 may be supplied to the first main compressor 120 and the first auxiliary compressor 130 along the first two-stage compression injection line 180.

In addition, some of the refrigerant flowing along the second two-stage compression line 222 flows along the second two-stage compression injection line 280. The refrigerant flowing along the second two-stage compression injection line 180 is expanded in the second two-stage compression injection expansion valve 282.

The refrigerant expanded in the second two-stage compression injection expansion valve 182 may be supplied to the second main compressor 220 and the second auxiliary compressor 230 along the second two-stage compression injection line 280.

The user can control and selectively use the two-stage compression injection expansion valves 182 and 282 as necessary.

The air conditioner according to the embodiment of the present invention may operate in the cooling mode, the one-stage heating mode and the two-stage heating mode using the same refrigerant pipes. In particular, since the one-stage heating mode and the two-stage heating mode are switched and used according to the outdoor temperature, it is possible to achieve high-capacity and high-efficiency operation.

The invention claimed is:

1. An outdoor system of an air conditioner comprising at least one outdoor unit, wherein the at least one outdoor unit includes:

a compressor;

an outdoor heat exchanger;

a pair of two-stage compression lines that extends to an outside of the outdoor unit;

a pair of connection lines that extends to the outside of the outdoor unit to enable communication with an indoor unit;

a plurality of valves configured to open and close the pair of two-stage compression lines and the pair of connection lines when the outdoor unit is driven in any one of a one-stage heating mode or a two-stage heating mode; and a two-stage compression injection line configured to connect at least one of the pair of two-stage compression lines with the compressor.

2. The outdoor system according to claim 1, wherein the at least one outdoor unit includes:

a first outdoor unit including a first compressor, a first outdoor heat exchanger, and a pair of first connection lines; and a second outdoor unit including a second compressor, a second outdoor heat exchanger, and a pair of second connection lines, wherein the first outdoor unit and the second outdoor unit communicate with each other through the pair of two-stage compression lines.

3. The outdoor system according to claim 2, wherein the pair of two-stage compression lines includes:

a first two-stage compression line, through which refrigerant passing through the second outdoor heat exchanger flows into the first outdoor unit; and a second two-stage compression line, through which refrigerant passing through the first compressor flows into the second outdoor unit.

4. The outdoor system according to claim 2, wherein each of the first and second outdoor units further includes a two-stage compression injection line configured to connect at least one of the pair of two-stage compression lines with the respective compressor.

5. The outdoor system according to claim 2, wherein the pair of first connection lines includes a first heat exchanger input/output line, through which gaseous refrigerant flows, and a first outdoor system connection line, through which liquid refrigerant flows, and wherein the pair of second connection lines includes a second heat exchanger input/output line, through which gaseous refrigerant flows, and a second outdoor system connection line, through which liquid refrigerant flows.

6. The outdoor system according to claim 5, wherein the plurality of valves is configured to:

close the pair of two-stage compression lines when the first outdoor unit and the second outdoor unit are driven in the one-stage heating mode, and close the first outdoor system connection line when the first outdoor unit and the second outdoor unit are driven in the two-stage heating mode.

7. The outdoor system according to claim 1, wherein the plurality of valves includes:

a main four-way valve disposed at an inlet side of the compressor; and an auxiliary four-way valve disposed at an outlet side of the compressor, wherein when the outdoor unit is switched from any one of the one-stage heating mode or the two-stage heating mode to the other thereof, any one of the main four-way valve or the auxiliary four-way valve is switched.

8. The outdoor system according to claim 6, wherein the at least one outdoor unit includes:

a first outdoor unit including a first compressor, a first outdoor heat exchanger, a first main four-way valve, and a first auxiliary four-way valve; and a second outdoor unit including a second compressor, a second outdoor heat exchanger, a second main four-way valve, and a second auxiliary four-way valve, wherein when the outdoor unit is switched from any one of the one-stage heating mode or the two-stage heating mode to the other thereof, any one of the first auxiliary four-way valve or the second main four-way valve is switched.

9. The outdoor system according to claim 1, wherein the pair of connection lines includes a heat exchanger input/output line, through which the outdoor heat exchanger and the indoor unit communicate with each other, and wherein the at least one outdoor unit further includes an injection line configured to connect the heat exchanger input/output line with the compressor.

10. The outdoor system according to claim 9, wherein the injection line includes:

an injection expansion valve; and an injection heat exchanger configured to exchange heat between the injection line, through which refrigerant expanded by the injection expansion valve flows, and the heat exchanger input/output line.

11. An outdoor system of an air conditioner, comprising:

a first outdoor unit including a first compressor, a first outdoor heat exchanger, a pair of first connection lines that connect the first outdoor unit directly to an indoor unit, and a pair of two-stage compression lines that extends to an outside of the first outdoor unit;

a second outdoor unit including a second compressor, a second outdoor heat exchanger, and a pair of second connection lines that connect the second outdoor unit directly to the indoor unit, wherein the first outdoor unit and the second outdoor unit are in direct communication with each other through the pair of two-stage compression lines; and a plurality of valves configured to open and close the pair of two-stage compression lines and the pair of first connection lines when the first outdoor unit is driven in any one of a one-stage heating mode or a two-stage heating mode, wherein the pair of two-stage compression lines includes:

a first two-stage compression line, through which refrigerant passing through the second outdoor heat exchanger flows into the first outdoor unit; and a second two-stage compression line, through which refrigerant passing through the first compressor flows into the second outdoor unit.

12. The outdoor system according to claim 11, wherein the pair of first connection lines includes a first heat exchanger input/output line, through which gaseous refrigerant flows, and a first outdoor system connection line, through which liquid refrigerant flows, and wherein the pair of second connection lines includes a second heat exchanger input/output line, through which gaseous refrigerant flows, and a second outdoor system connection line, through which liquid refrigerant flows.

13. The outdoor system according to claim 12, wherein the plurality of valves is configured to:

close the pair of two-stage compression lines when the first outdoor unit and the second outdoor unit are driven in the one-stage heating mode, and close the first outdoor system connection line when the first outdoor unit and the second outdoor unit are driven in the two-stage heating mode.

14. The outdoor system according to claim 11, wherein the first outdoor unit further includes:

a first main four-way valve disposed at an inlet side of the first compressor; and a first auxiliary four-way valve disposed at an outlet side of the first compressor, wherein when the first outdoor unit is switched from any one of the one-stage heating mode or the two-stage heating mode to the other thereof, any one of the first main four-way valve or the first auxiliary four-way valve is switched.

15. The outdoor system according to claim 14, wherein the second outdoor unit further includes:

a second main four-way valve disposed at an outlet side of the second compressor; and a second auxiliary four-way valve disposed at an outlet side of the second compressor, wherein when the first outdoor unit is switched from any one of the one-stage heating mode or the two-stage heating mode to the other thereof, any one of the first auxiliary four-way valve or the second main four-way valve is switched.

16. The outdoor system according to claim 11, wherein each of the pair of first and second connection lines includes a heat exchanger input/output line, through which the respective outdoor heat exchanger and the indoor unit communicate with each other, and wherein the respective outdoor unit further includes an injection line configured to connect the heat exchanger input/output line with the respective compressor.

17. The outdoor system according to claim 16, wherein the injection line includes:

an injection expansion valve; and an injection heat exchanger configured to exchange heat between the injection line, through which refrigerant expanded by the injection expansion valve flows, and the heat exchanger input/output line.

18. An outdoor system of an air conditioner comprising a plurality of outdoor units, wherein each of the plurality of outdoor units includes:

a compressor;

an outdoor heat exchanger;

a pair of two-stage compression lines that extends to an outside of the respective outdoor unit;

a pair of connection lines that extends to the outside of the outdoor unit to enable direct communication with an indoor unit; and a plurality of valves configured to open and close the pair of two-stage compression lines and the pair of connection lines when the outdoor unit is driven in any one of a one-stage heating mode or a two-stage heating mode, wherein the pair of two-stage compression lines includes:

a first two-stage compression line, through which refrigerant passing through the outdoor heat exchanger of another of the plurality of outdoor units flows into the outdoor unit; and a second two-stage compression line, through which refrigerant passing through the compressor flows into the another of the plurality of outdoor units, and wherein the plurality of valves is configured to:

close the pair of two-stage compression lines when the outdoor unit is driven in the one-stage heating mode, and close an outdoor system connection line of the pair of connection lines when the outdoor unit and the another of the plurality of outdoor units are driven in the two-stage heating mode.

* * * * *